US009927731B2

(12) United States Patent
Takagami

(10) Patent No.: US 9,927,731 B2
(45) Date of Patent: Mar. 27, 2018

(54) IMAGE FORMING APPARATUS HAVING AN ELECTRIFYING MEMBER FOR ELECTRIFYING AN IMAGE CARRIER

(71) Applicant: KYOCERA Document Solutions Inc., Osaka (JP)

(72) Inventor: Ai Takagami, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/474,454

(22) Filed: Mar. 30, 2017

(65) Prior Publication Data

US 2017/0285509 A1 Oct. 5, 2017

(30) Foreign Application Priority Data

Apr. 4, 2016 (JP) ..... 2016-075149
Apr. 4, 2016 (JP) ..... 2016-075150

(51) Int. Cl.
*G03G 15/02* (2006.01)

(52) U.S. Cl.
CPC ..... *G03G 15/0266* (2013.01)

(58) Field of Classification Search
CPC ..... G03G 15/0266; G03G 21/0005; G03G 21/0058; G03G 21/0094
See application file for complete search history.

(56) References Cited

U.S. PATENT DOCUMENTS

2008/0069618 A1* 3/2008 Ishino ..... G03G 5/08214 399/360
2008/0118289 A1* 5/2008 Sato ..... G03G 21/0058 399/357
2013/0223904 A1* 8/2013 Goda ..... G03G 21/0005 399/349
2015/0063837 A1* 3/2015 Tsujita ..... G03G 21/0005 399/26

FOREIGN PATENT DOCUMENTS

JP H 11-003014 A 1/1999
JP 2007-199094 A 8/2007
JP 2012-047879 A 3/2012

* cited by examiner

*Primary Examiner* — Sandra Brase
(74) *Attorney, Agent, or Firm* — Stein IP, LLC

(57) ABSTRACT

An image forming apparatus includes a high voltage generating circuit, a voltage controller, a current detector, and a recovery process controller. If two inflection points (O and P) exist, which exist on a characteristic curve indicating a relationship between the voltage value and the current value when the frequency of the AC voltage is set as a first frequency or when a photosensitive drum is rotated at a first linear speed, the recovery process is performed if a potential difference between a first inter-inflection-point voltage (OP) between inflection points and a second inter-inflection-point voltage (OP') between inflection points (O' and P') when setting a second frequency different from the first frequency, or a potential difference between the first voltage and a third inter-inflection-point voltage (OP") between inflection (Continued)

points (O" and P") when setting a second linear speed different from the first linear speed becomes a predetermined value or less.

6 Claims, 6 Drawing Sheets

IMAGE FORMING APPARATUS HAVING AN ELECTRIFYING MEMBER FOR ELECTRIFYING AN IMAGE CARRIER

INCORPORATION BY REFERENCE

This application is based upon and claims the benefit of priority from the corresponding Japanese Patent Applications No. 2016-75149 and No. 2016-75150 filed Apr. 4, 2016, the entire contents of which are hereby incorporated by reference.

BACKGROUND

The present disclosure relates to an image forming apparatus including an electrifying member for electrifying an image carrier, and particularly to an image forming apparatus that can perform recovery process for reducing frictional resistance of the surface of the image carrier.

Conventionally, in an image forming apparatus using an electrophotographic process such as a laser printer or a digital multifunction peripheral, the surface of the photosensitive drum (image carrier) having photoconductivity is uniformly electrified by an electrifying device, an electrostatic latent image is formed by exposure with an exposing device, and the electrostatic latent image is developed into a toner image by a developing device. Next, the toner image is transferred onto the surface of the recording medium such as a paper sheet by a transfer portion, and the toner image is fixed to the surface of the recording medium by a fixing portion. Thus, the series of image forming process is finished. In addition, toner remaining on the surface of the photosensitive drum after the toner image transfer is removed by a cleaning portion, and further, remaining charge is eliminated using a charge elimination lamp, as necessary, as a preparation for a next image formation.

In recent years, an amorphous silicon (a-Si) photosensitive drum is widely used as the image carrier of the image forming apparatus. The a-Si photosensitive drum has a high degree of hardness and a superior durability, and characteristics as a photoreceptor is hardly deteriorated after using for a long period of time so that high image quality can be maintained. Therefore, the image carrier can be easily handled with low running cost, and it is superior with high safety to environment.

As to the image forming apparatus using such the a-Si photosensitive drum, it is known that an image deletion is apt to occur due to its characteristics. In other words, when electrification is performed using the electrifying device, discharge from the electrifying device generates ozone. The ozone decomposes components in the air, and hence ionic products such as NOx and SOx are generated. The ionic products are water soluble and stick to the photosensitive drum so as to enter in a coarse structure of approximately 0.1 μm on the surface of the photosensitive drum, and hence they cannot be removed by a cleaning system used in a general-purpose machine. Further, if they absorb moisture in the air, resistance of the surface of the photosensitive drum is decreased. Thus, potential lateral flow occurs at an edge part of the electrostatic latent image formed on the surface of the photosensitive drum, and as a result, an image deletion may occur.

Therefore, there is proposed a method of suppressing a decrease in the resistance of the surface of the photosensitive drum with a simple structure so as to reduce the image deletion, and there is known a method of performing a refresh mode at a predetermined timing, in which the photoreceptor is ground by interaction between developer containing abrasive (grinding toner) and a grinding member (a rubbing roller and a cleaning blade), so as to remove the products generated by ozone without using a heater or the like. In this method, developer is printed or developed when printing is not performed (in a start mode of the apparatus or in a standby mode after printing), and the developer is not transferred to the recording medium but is supplied to the grinding member in the photoreceptor unit so as to be used for grinding the surface of the photosensitive drum.

In addition, in recent years, instead of a corotron type or scorotron type electrifying device, a contact electrification type electrifying device with little generation of ozone is used, in which the electrifying member (an electrifying roller or the like) is disposed in contact with or close to the photosensitive drum so as to electrify the photosensitive drum. Among this type of electrifying members, there is one to which an oscillation voltage is applied, in which a DC voltage and an AC voltage are superimposed, so that the photosensitive drum is electrified, and there is known one that can set an appropriate peak-to-peak voltage value (Vpp) of a high accuracy AC voltage despite of environmental variation such as temperature and humidity or secular change of the photosensitive drum, the electrifying member, or the like.

SUMMARY

An image forming apparatus according to an aspect of the present disclosure includes an image carrier, an electrifying member, a high voltage generating circuit, a voltage controller, a current detector, and a recovery process controller. The image carrier has a surface on which a photosensitive layer is formed. The electrifying member electrifies the image carrier. The high voltage generating circuit applies an oscillation voltage, in which a DC voltage and an AC voltage are superimposed, to the electrifying member. The voltage controller controls peak-to-peak voltage value Vpp and frequency of the AC voltage. The current detector detects DC current value Idc between the electrifying member and the image carrier. The recovery process controller can perform a recovery process for decreasing frictional resistance of the surface of the image carrier. The voltage controller determines whether or not two inflection points O and P exist, which exist on a characteristic curve on a two-dimensional coordinate system indicating a relationship between the voltage value Vpp and the current value Idc, when applying the oscillation voltage to the electrifying member by setting the frequency of the AC voltage as a first frequency or by rotating the image carrier at a first linear speed, so as to increase the voltage value Vpp. When the oscillation voltage is applied to the electrifying member by setting the frequency of the AC voltage as the first frequency and if the two inflection points O and P exist, a first inter-inflection-point voltage OP between the inflection points O and P and a second inter-inflection-point voltage OP' between two inflection points O' and P' are calculated, the two inflection points O' and P' existing on the characteristic curve when the oscillation voltage is applied to the electrifying member by setting the frequency of the AC voltage as a second frequency different from the first frequency, so as to increase the voltage value Vpp. When the oscillation voltage is applied to the electrifying member by rotating the image carrier at the first linear speed and if the two inflection points O and P exist, the first inter-inflection-point voltage OP between the inflection points O and P and a third inter-inflection-point voltage OP" between two inflection points O" and P" are calculated, the two inflection points O" and P" existing on the characteristic curve when the oscillation voltage is applied to the electrifying member by rotating the image carrier at a second linear speed different from the first linear speed so as to increase the voltage value Vpp. The recovery process controller performs the recovery process when a potential difference between the first inter-inflection-point voltage OP and the second inter-inflection-point voltage OP' or a potential difference between the first inter-inflection-point voltage OP and the third inter-inflection-point voltage OP" is a predetermined value or less.

Further features and advantages of the present disclosure will become apparent from the description of embodiments given below.

DETAILED DESCRIPTION

Figure 1:
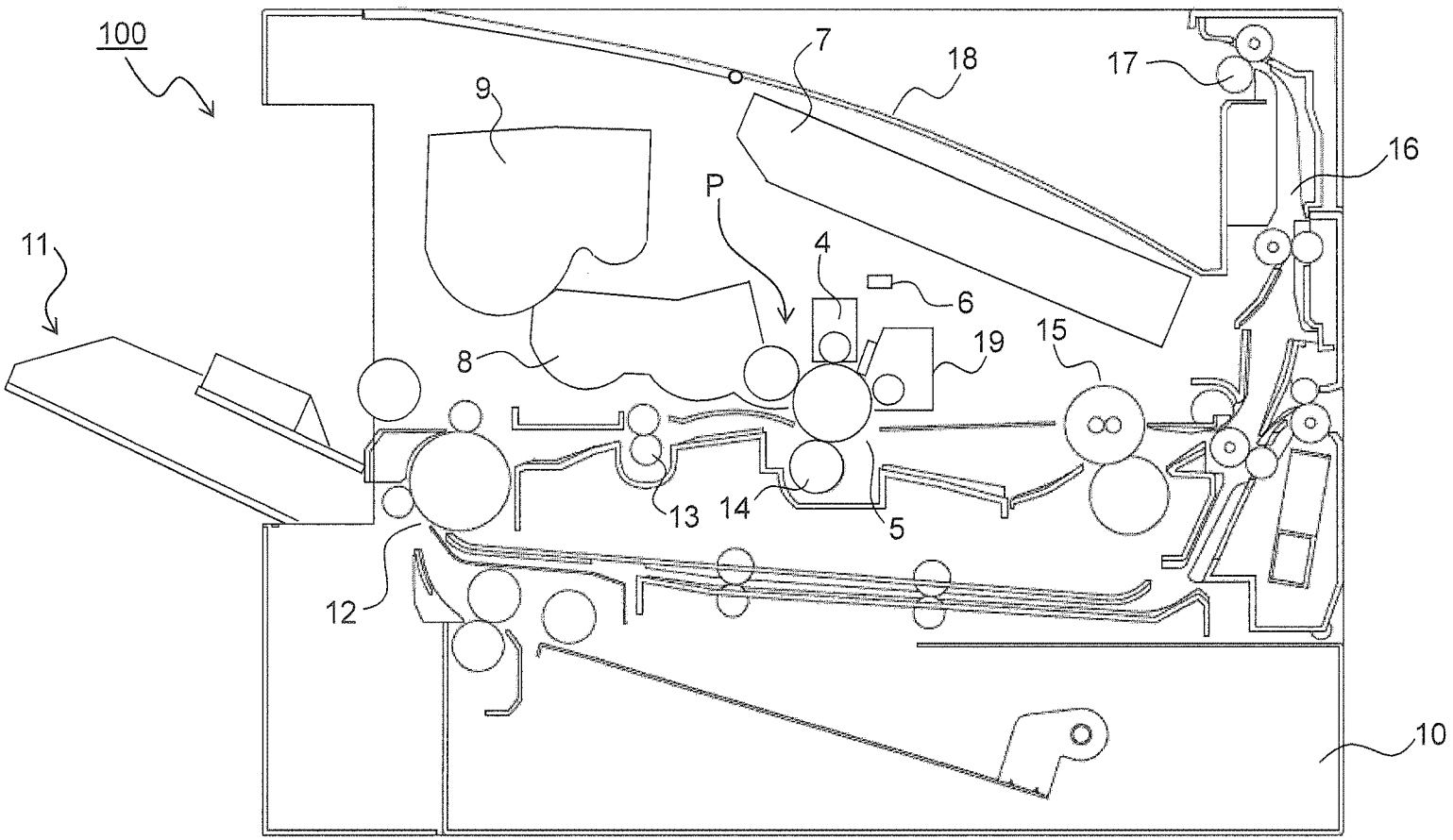
FIG. 1 is a cross-sectional side view illustrating an inner structure of an image forming apparatus according to an embodiment of the present disclosure.

Hereinafter, embodiments of the present disclosure is described with reference to the drawings. FIG. 1 is a cross-sectional side view illustrating an inner structure of an image forming apparatus 100 according to an embodiment of the present disclosure. In the image forming apparatus (monochrome printer in this example) 100, there is disposed an image forming portion P that forms a monochrome image by processes of electrification, exposure, development and transfer. In the image forming portion P, there are disposed, in order in a rotation direction of a photosensitive drum 5 (counterclockwise direction in FIG. 1), an electrifying device 4, an exposure unit (laser scanning unit or the like) 7, a developing device 8, a transfer roller 14, a cleaning device 19, and a charge eliminating device 6.

The photosensitive drum 5 includes, for example, a drum tube made of aluminum and an amorphous silicon layer formed on the surface of the drum tube by vapor deposition as a photosensitive layer of a positive electrification type photoconductor, and has a diameter of approximately 30 mm. The photosensitive drum 5 is configured to be driven by a drum driving portion (not shown) to rotate at a constant speed about a support shaft.

When performing the image forming operation, the photosensitive drum 5 rotating in counterclockwise direction is uniformly electrified by the electrifying device 4, an electrostatic latent image is formed on the photosensitive drum 5 by a laser beam from the exposure unit 7 based on document image data, and the developing device 8 makes developer (hereinafter referred to as toner) adhere to the electrostatic latent image so as to form a toner image.

Toner is supplied to the developing device 8 from a toner container 9. Note that the image data is transmitted from a personal computer (not shown) or the like. In addition, the charge eliminating device 6 for eliminating remaining charge on the surface of the photosensitive drum 5 is disposed on the downstream side of the cleaning device 19 in the rotation direction of the photosensitive drum 5.

A paper sheet (recording medium) is conveyed to the photosensitive drum 5, on which the toner image is formed as described above, from a sheet feed cassette 10 or a manual sheet feeding device 11 via a paper sheet conveying path 12 and a registration roller pair 13, and the transfer roller 14 transfers the toner image formed on the surface of the photosensitive drum 5 to the paper sheet. The paper sheet with the transferred toner image is separated from the photosensitive drum 5 and conveyed to a fixing device 15, so that the toner image is fixed. The paper sheet after passing through the fixing device 15 is conveyed to an upper part of the apparatus via a paper sheet conveying path 16 and is discharged by a discharge roller pair 17 onto a discharge tray 18.

Figure 2:
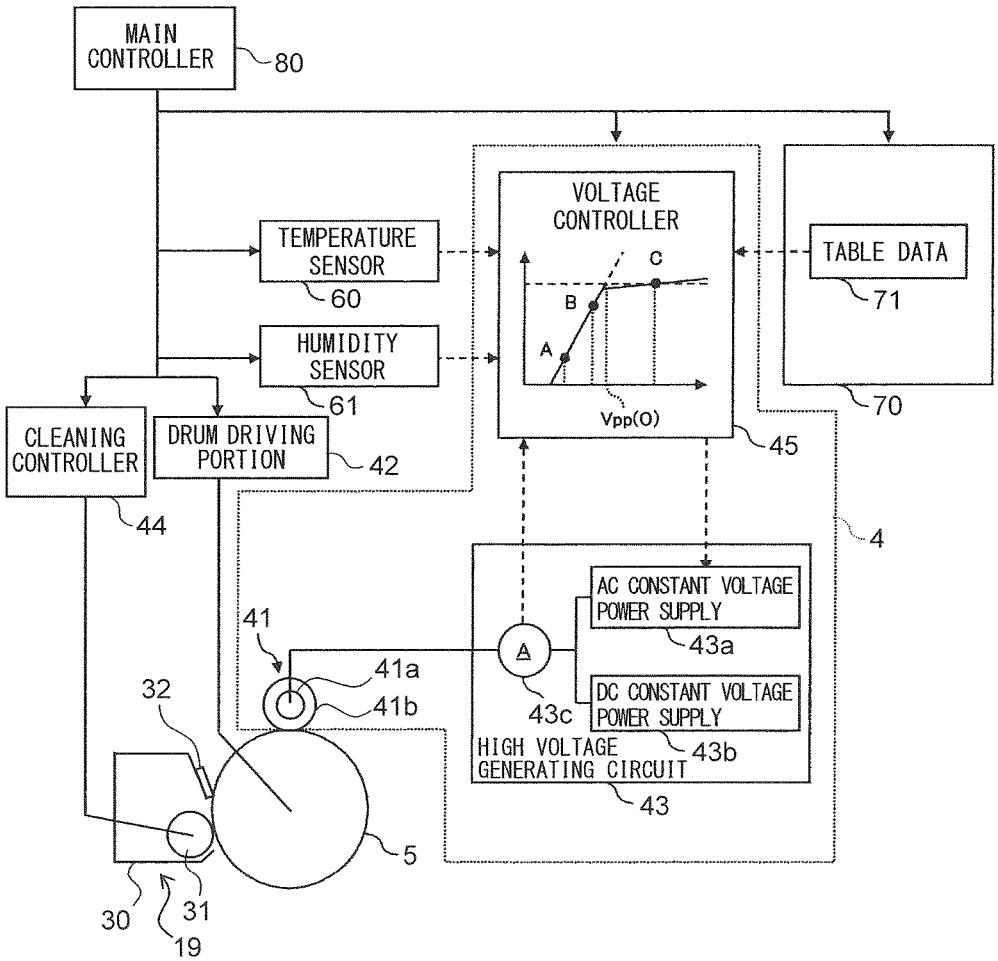
FIG. 2 is a block diagram illustrating a control route of an electrifying device in an image forming apparatus according to a first embodiment of the present disclosure.

FIG. 2 is a block diagram illustrating a control route of the electrifying device 4 in the image forming apparatus 100 according to a first embodiment of the present disclosure. Note that FIG. 2 illustrates the image forming apparatus 100 viewed from the rear side of FIG. 1, and hence positions of the electrifying device 4 and the cleaning device 19 with respect to the photosensitive drum 5 are opposite to those in FIG. 1 in the left and right direction.

First, a structure of the cleaning device 19 is described. As illustrated in FIG. 2, the cleaning device 19 includes a housing 30 having an opening facing the photosensitive drum 5, a rubbing roller 31 and a cleaning blade 32 for removing toner remaining on the surface of the photosensitive drum 5.

The rubbing roller 31 is pressed to contact with the photosensitive drum 5 at a predetermined pressure and is pivoted at front and rear plates (not shown) of the housing 30 in a rotatable manner. The rubbing roller 31 is driven by a driving device (not shown) to rotate in the same direction in the contact surface with the photosensitive drum 5, and the circumferential speed thereof is controlled to be 1.2 times the circumferential speed of the photosensitive drum 5. As the rubbing roller 31, there is one having a structure in which a foam layer as a roller body made of EPDM rubber having an Asker C type hardness of 55 degrees is formed around a metal shaft, for example. The material of the roller body is not limited to EPDM rubber but may be other material rubber or foam rubber, which preferably have an Asker C type hardness of 10 to 90 degrees. The rubbing roller 31 has a function of removing residual toner on the surface of the photosensitive drum 5 and a function of holding toner containing abrasive between itself and the photosensitive drum 5 so as to grind the surface of the drum.

The cleaning blade 32 is fixed to the housing 30 so as to contact with the photosensitive drum 5 on the downstream side of the contact point between the photosensitive drum 5 and the rubbing roller 31 in the rotation direction of the photosensitive drum 5 (in clockwise direction in FIG. 2). As the cleaning blade 32, a blade made of polyurethane rubber having a JIS hardness of 78 degrees is used, for example, and the blade is attached at a predetermined angle with respect to the tangential direction at the contact point with the photosensitive drum 5. The contact pressure of the cleaning blade 32 to the photosensitive drum 5 is set to approximately 5 g/mm$^2$, for example. Note that material, hardness, and size of the cleaning blade 32, and penetration and contact pressure thereof to the photosensitive drum 5, and the like can be appropriately set according to specification of the photosensitive drum 5.

The residual toner removed from the surface of the photosensitive drum 5 by the rubbing roller 31 and the cleaning blade 32 is discharged to the outside of the cleaning device 19 by rotation of a feed spiral (not shown). As the toner used in the present disclosure, there is toner containing silica, titanium oxide, strontium titanate, alumina, or the like as abrasive embedded and held to partially protrude from the surface of toner matrix particles, or toner containing abrasive adhered to the surface of the toner in an electrostatic manner.

Next, a structure of the electrifying device 4 is described. The electrifying device 4 includes an electrifying roller 41 that is disposed in contact with the photosensitive drum 5 so as to electrify the photosensitive drum 5, a high voltage generating circuit 43 that generates an oscillation voltage, in which a DC voltage and an AC voltage are superimposed, applied to the electrifying roller 41, and a voltage controller 45 that controls a peak-to-peak voltage value (Vpp) of the AC voltage.

The electrifying roller 41 is constituted of a core metal 41*a* and an electro conductive layer 41*b* made of material such as epichlorohydrin rubber having electro conductivity and elasticity, which is coated around the core metal 41*a*. The electrifying roller 41 is disposed in a rotatable manner while the surface of the electro conductive layer 41*b* contacts with the surface of the photosensitive drum 5. The electrifying roller 41 is connected to the high voltage generating circuit 43 and is electrified when the oscillation voltage is applied from the high voltage generating circuit 43.

The high voltage generating circuit 43 includes an AC constant voltage power supply 43*a* that outputs the AC voltage, a DC constant voltage power supply 43*b* that outputs the DC voltage, and a current detector 43*c* that detects DC current value Idc between the electrifying roller 41 and the photosensitive drum 5. The high voltage generating circuit 43 superimposes the AC voltage output from the AC constant voltage power supply 43*a* on the DC voltage output from the DC constant voltage power supply 43*b* so as to generate the oscillation voltage, and applies the oscillation voltage to the electrifying roller 41. The AC constant voltage power supply 43*a* outputs the AC voltage having a peak-to-peak voltage value Vpp controlled by the voltage controller 45 described later, and the DC constant voltage power supply 43*b* outputs a constant DC voltage.

In addition, the image forming apparatus 100 of the present disclosure is configured to be capable of performing a refresh operation (grinding operation) when transferring to the paper sheet is not performed, for example, when the image forming apparatus 100 is activated from a power off state or a sleep (power saving) mode to a copy start state. In the refresh operation, a step of feeding toner on the development roller in the developing device 8 to the photosensitive drum 5 side, and a step of grinding the surface of the photosensitive drum 5 by supplying the toner fed to the photosensitive drum 5 side by the toner feeding step to the rubbing roller 31 and by driving the rubbing roller 31 to rotate are performed one or more times each.

Next, a control system of the image forming apparatus 100 is described with reference to FIG. 2. The image forming apparatus 100 includes a main controller 80 constituted of a CPU and the like. The main controller 80 is connected to a storage portion 70 constituted of a ROM, a RAM, and the like. The main controller 80 controls individual portions of the image forming apparatus 100 (the electrifying device 4, the developing device 8, the transfer roller 14, the cleaning device 19, the fixing device 15, and the like) based on a control program and control data stored in the storage portion 70.

For example, the main controller 80 is connected to a drum driving portion 42, the voltage controller 45, a cleaning controller (recovery process controller) 44, a temperature sensor 60, and a humidity sensor 61. Note that the voltage controller 45 and the cleaning controller 44 may be constituted of the control program stored in the storage portion 70. The temperature sensor 60 and the humidity sensor 61 are used for detecting temperature and humidity in the image forming apparatus 100, respectively.

Figure 3:
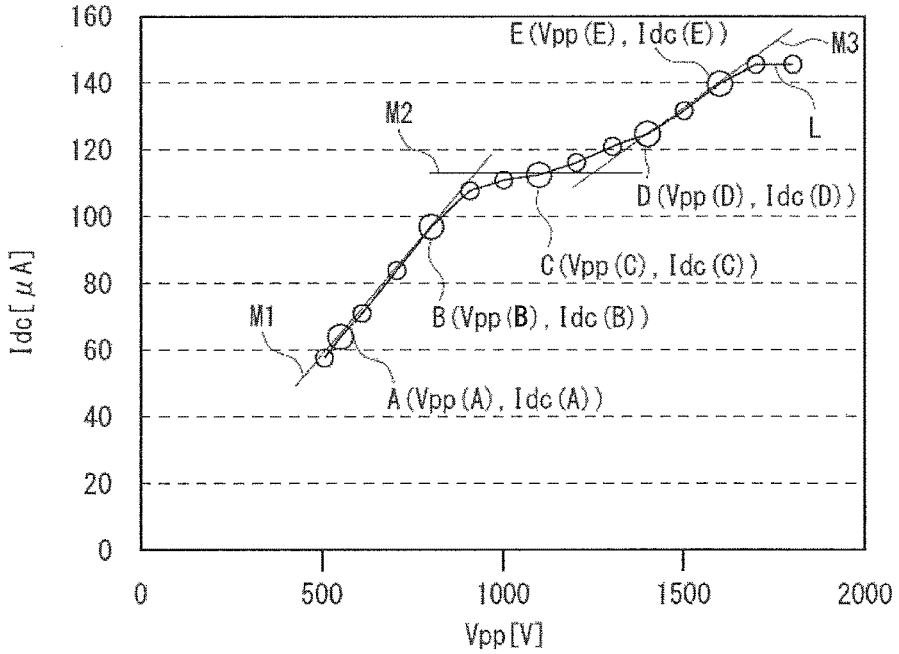
FIG. 3 is a graph illustrating an assumed characteristic curve of a relationship between a peak-to-peak voltage value Vpp and a DC current value Idc of an electrifying roller.

The storage portion 70 has a peak-to-peak voltage table 71 that stores plurality of different peak-to-peak voltage values Vpp in advance as the peak-to-peak voltage values Vpp used for controlling the oscillation voltage applied to the electrifying roller 41. For example, the peak-to-peak voltage table 71 stores peak-to-peak voltage values Vpp(A), Vpp(B), Vpp(C), Vpp(D), and Vpp(E) as illustrated in FIG. 3. Note that the peak-to-peak voltage values Vpp(A) and Vpp(B) are set to values assumed to be lower than the voltage value at the inflection point O that appears on an assumed characteristic curve L describe below (see FIG. 3), while the peak-to-peak voltage values Vpp(D) and Vpp(E) are set to values assumed to be higher than the voltage value at the inflection point O that appears on the assumed characteristic curve L describe below (see FIG. 3). In addition, the peak-to-peak voltage table 71 should store the plurality of peak-to-peak voltage values Vpp(A), Vpp(B), Vpp(C), Vpp(D), and Vpp(E) corresponding to various combinations of temperature and humidity in the image forming apparatus 100.

The drum driving portion 42 is constituted of a drum motor or the like controlled by the main controller 80 to rotate the photosensitive drum 5. The cleaning controller 44 controls the cleaning device 19 to perform the refresh operation of the surface of the photosensitive drum 5 for a predetermined period of time.

The voltage controller 45 controls the high voltage generating circuit 43 to apply the oscillation voltage to the electrifying roller 41. Specifically, the voltage controller 45 controls the AC constant voltage power supply 43*a* of the high voltage generating circuit 43 to generate the AC voltage having an appropriate peak-to-peak voltage value Vpp.

For example, the appropriate peak-to-peak voltage value Vpp is determined at a timing before printing operation or the like, and the method of determining the appropriate peak-to-peak voltage value Vpp is as follows. The voltage controller 45 reads a plurality of peak-to-peak voltage values Vpp from the peak-to-peak voltage table 71 in the storage portion 70 and controls the AC constant voltage power supply 43*a* of the high voltage generating circuit 43 to sequentially generate a plurality of AC voltages having a plurality of peak-to-peak voltage values Vpp, respectively, while increasing the peak-to-peak voltage value Vpp. The voltage controller 45 preferably reads the plurality of peak-to-peak voltage values Vpp from the peak-to-peak voltage table 71 based on the temperature in the image forming apparatus 100 detected by the temperature sensor 60 and the humidity in the image forming apparatus 100 detected by the humidity sensor 61.

In addition, when generating the AC voltages having the peak-to-peak voltage values Vpp, the voltage controller 45 obtains the DC current values Idc generated between the photosensitive drum 5 and the electrifying roller 41, which is the DC current values Idc corresponding to the peak-to-peak voltage values Vpp, from the current detector 43*c*. For example, the voltage controller 45 obtains a plurality of DC current values Idc(A), Idc(B), Idc(C), Idc(D), and Idc(E) respectively corresponding to the plurality of peak-to-peak voltage values Vpp(A), Vpp(B), Vpp(C), Vpp(D), and Vpp (E) stored in the peak-to-peak voltage table 71 as illustrated in FIG. 3.

Further, the voltage controller 45 calculates the assumed characteristic curve L on the two-dimensional coordinates indicating a relationship between the plurality of peak-to-peak voltage values Vpp and the DC current values Idc corresponding thereto, and refers to the assumed characteristic curve L for detecting the inflection points O and P appearing on the assumed characteristic curve L. For example, as illustrated in FIG. 3, the voltage controller 45 calculates the assumed characteristic curve L indicating a relationship between the plurality of peak-to-peak voltage values Vpp(A), Vpp(B), Vpp(C), Vpp(D), and Vpp(E) and a plurality of DC current values Idc(A), Idc(B), Idc(C), Idc(D), and Idc(E) corresponding thereto.

Here, the voltage controller 45 calculates a straight line M1 passing through coordinates A(Vpp(A), Idc(A)) and coordinates B(Vpp(B), Idc(B)) on the assumed characteristic curve L constituted of the peak-to-peak voltage values Vpp(A) and Vpp(B) assumed to be lower than the voltage value at the inflection point O and the DC current values Idc(A) and Idc(B) corresponding thereto. In addition, the voltage controller 45 calculates a straight line M2 that passes through coordinates C(Vpp(C), Idc(C)) on the assumed characteristic curve L constituted of an intermediate peak-to-peak voltage value Vpp(C) and the DC current value Idc(C) corresponding thereto and is parallel to the coordinate axis indicating the peak-to-peak voltage value Vpp. Then, the voltage controller 45 detects intersection coordinates between the straight line M1 and the straight line M2 as the inflection point O and determines the peak-to-peak voltage value Vpp corresponding to the inflection point O as the appropriate peak-to-peak voltage value Vpp(O).

Further, the voltage controller 45 calculates a straight line M3 passing through coordinates D(Vpp(D), Idc(D)) and coordinates E(Vpp(E), Idc(E)) on the assumed characteristic curve L constituted of the peak-to-peak voltage values Vpp(D) and Vpp(E) assumed to be higher than the voltage value at the inflection point O and the DC current values Idc(D) and Idc(E) corresponding thereto. Further, the voltage controller 45 detects an intersection coordinates between the straight line M2 and the straight line M3 as an inflection point P and calculates a peak-to-peak voltage value Vpp(P) corresponding to the inflection point P. In this way, the voltage controller 45 can detect the two inflection points O and P from the assumed characteristic curve L illustrated in FIG. 3.

Here, if ionic products, moisture, paper powder, or the like sticks to the surface of the photosensitive drum 5 so that the resistance of the surface of the photosensitive drum 5 is decreased, the photosensitive drum 5 cannot keep the electrostatic latent image formed on the surface, and potential lateral flow (leak) occurs at an edge part of the electrostatic latent image. As a result, an image deletion occurs in the formed image. In the case where the surface of the photosensitive drum 5 has a normal resistance, when increasing the peak-to-peak voltage value Vpp of the AC voltage from a voltage lower than the appropriate peak-to-peak voltage value Vpp to a voltage higher than the same while applying the oscillation voltage based on the AC voltage to the electrifying roller 41, the DC current value Idc detected by the current detector 43*c* can be easily maintained at approximately the appropriate peak-to-peak voltage value Vpp. In other words, a voltage difference between the two inflection points O and P appearing on the assumed characteristic curve L illustrated in FIG. 3 becomes relatively large.

However, in the case where the resistance of the surface of the photosensitive drum 5 is decreased in a high temperature and high humidity environment, when increasing the peak-to-peak voltage value Vpp of the AC voltage as described above, the DC current value Idc detected by the current detector 43*c* is hardly maintained at approximately the appropriate peak-to-peak voltage value Vpp. In other words, the voltage difference between the two inflection points O and P appearing on the assumed characteristic curve L illustrated in FIG. 3 becomes small.

Therefore, the cleaning controller 44 sets execution time of the refresh operation by the cleaning device 19 on the basis of the two inflection points O and P detected from the assumed characteristic curve L by the voltage controller 45. Specifically, as the voltage difference between the two inflection points O and P appearing on the assumed characteristic curve L (difference of the peak-to-peak voltage value Vpp) is smaller, the execution time of the refresh operation is set to be longer. For example, the cleaning controller 44 sets the execution time to eight minutes when the voltage difference between the two inflection points O and P is 200 V or lower, it sets the execution time to 5 minutes when the voltage difference is 200 to 500 V, and it sets the execution time to 2 minutes when the voltage difference is 500 V or higher.

Thus, when the resistance of the surface of the photosensitive drum 5 is decreased, the refresh operation by the cleaning device 19 is performed for relatively long period of time, and hence the surface of the photosensitive drum 5 is sufficiently ground so that a decrease in the surface resistance can be avoided. As a result, the photosensitive drum 5 can appropriately maintain the electrostatic latent image on the surface, and hence potential lateral flow at an edge part of the electrostatic latent image can be prevented so that image deletion can be prevented.

Note that the cleaning controller 44 sets the execution time of the refresh operation by the cleaning device 19 to be relatively short when the voltage difference between the two inflection points O and P appearing on the assumed characteristic curve L is relatively large, and therefore when the surface of the photosensitive drum 5 has a normal resistance, the execution time of the refresh operation can be set to be short. Thus, the cleaning device 19 does not wastefully grind the photosensitive drum 5, and hence the life of the photosensitive drum 5 is not shortened more than necessary. In addition, power consumption for driving the cleaning device 19 can be controlled.

In this way, by measuring the DC current value Idc of the electrifying roller 41 whose characteristics are varied depending on environmental condition, it is possible to correctly know the environment in the vicinity of the surfaces of the photosensitive drum 5 and the electrifying roller so that the refresh operation can be appropriately controlled.

Here, Vpp-Idc characteristics are determined by both a dew condensation state on the surface of the photosensitive drum 5 and electrification ability of the electrifying roller 41. Therefore, the state where the two inflection points O and P appear includes, in addition to the high temperature and high humidity environment described above, a state in which durability of the electrifying roller 41 is deteriorated under a low temperature and low humidity environment so that electrification ability of the electrifying roller 41 is impaired.

When the electrification ability of the electrifying roller 41 is impaired, Vpp at the inflection point O is increased while Idc is decreased, and a variation of Idc between the inflection points O and P is increased. Then, in the Vpp-Idc characteristics, it becomes as if the inflection point O and the inflection point P are close to each other. As a result, when the refresh operation is performed according to the control method described above, unnecessary refresh operation is performed under the low temperature and low humidity environment.

On the other hand, the Vpp-Idc characteristics vary depending on frequency of the AC voltage applied to the electrifying roller 41. The frequency in normal printing is usually higher than 2,000 Hz. This is the frequency necessary for maintaining uniformity of electrification. If the frequency becomes 2,000 Hz or lower, the number of discharge times in the vicinity of the nip between the photosensitive drum 5 and the electrifying roller 41 is decreased resulting in nonuniform image quality. Alternatively, a jitter appears in the image at a pitch corresponding to the space frequency determined by the frequency and the linear speed of the electrifying roller 41. On the other hand, as the frequency becomes higher, responsiveness of the electrifying roller 41 (tracking performance of electro conductive material contained in the electro conductive layer 41*b* to the frequency) becomes worse resulting in the characteristics in which Vpp of the inflection point O is increased as described above.

In order to electrify the photosensitive drum 5 more uniformly, it is ideal to set the frequency as high as possible for the electrifying roller 41 to respond, but the inflection points O and P can hardly be determined, and the Vpp-Idc characteristics become as those under the high humidity environment. However, by decreasing the frequency, the responsiveness of the electrifying roller 41 is increased so that a change appears in the Vpp-Idc characteristics.

Figure 4:
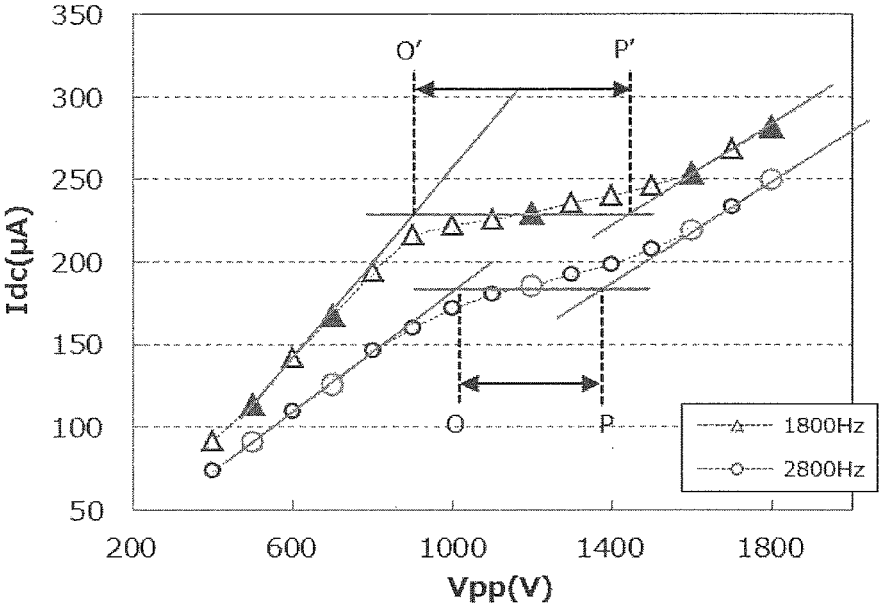
FIG. 4 is a graph illustrating an assumed characteristic curve of a relationship between the peak-to-peak voltage value Vpp and the DC current value Idc of the electrifying roller when a frequency of an AC voltage is changed in two levels.

FIG. 4 is a graph illustrating an assumed characteristic curve of a relationship between the peak-to-peak voltage value Vpp and the DC current value Idc of the electrifying roller 41 when the frequency of the AC voltage is changed in two levels. As illustrated in FIG. 4, the frequency of the AC voltage applied to the electrifying roller 41 is changed in two levels of a frequency in the normal printing and a frequency lower than that in the normal printing, so as to obtain the Vpp-Idc characteristics. Then, there is determined an inter-inflection-point voltage OP (=Vpp(P)−Vpp(O), a first inter-inflection-point voltage) when the frequency in the normal printing is applied (data series of "○" in FIG. 4), and an inter-inflection-point voltage OP' (=Vpp(P)'−Vpp(O)', a second inter-inflection-point voltage) when the frequency is decreased (data series of "Δ" in FIG. 4).

If occurrence of the two inflection points O and P is due to the high humidity environment, the first inter-inflection-point voltage OP and the second inter-inflection-point voltage OP' are not largely varied even if the frequency is changed, and hence the voltage difference (OP'−OP) is decreased. On the other hand, if occurrence of the two inflection points O and P is due to deterioration of the electrifying roller 41, the second inter-inflection-point voltage OP' becomes larger than the first inter-inflection-point voltage OP, and hence the voltage difference (OP'−OP) is increased.

The image forming apparatus 100 of the first embodiment utilizes the above-mentioned change of the Vpp-Idc characteristics due to the frequency, and when determining whether or not the refresh operation is necessary, it obtains the Vpp-Idc characteristics by setting the frequency of the AC voltage in two levels of the frequency in the normal printing (first frequency) and the frequency (second frequency) lower than the first frequency in the Vpp-Idc characteristics obtained by the voltage controller 45. Then, on the basis of the obtained Vpp-Idc characteristics, it is determined whether the voltage difference between the two inflection points O and P is due to the high temperature and high humidity environment, or due to deterioration of the electrifying roller 41 in the low temperature and low humidity environment.

Figure 5:
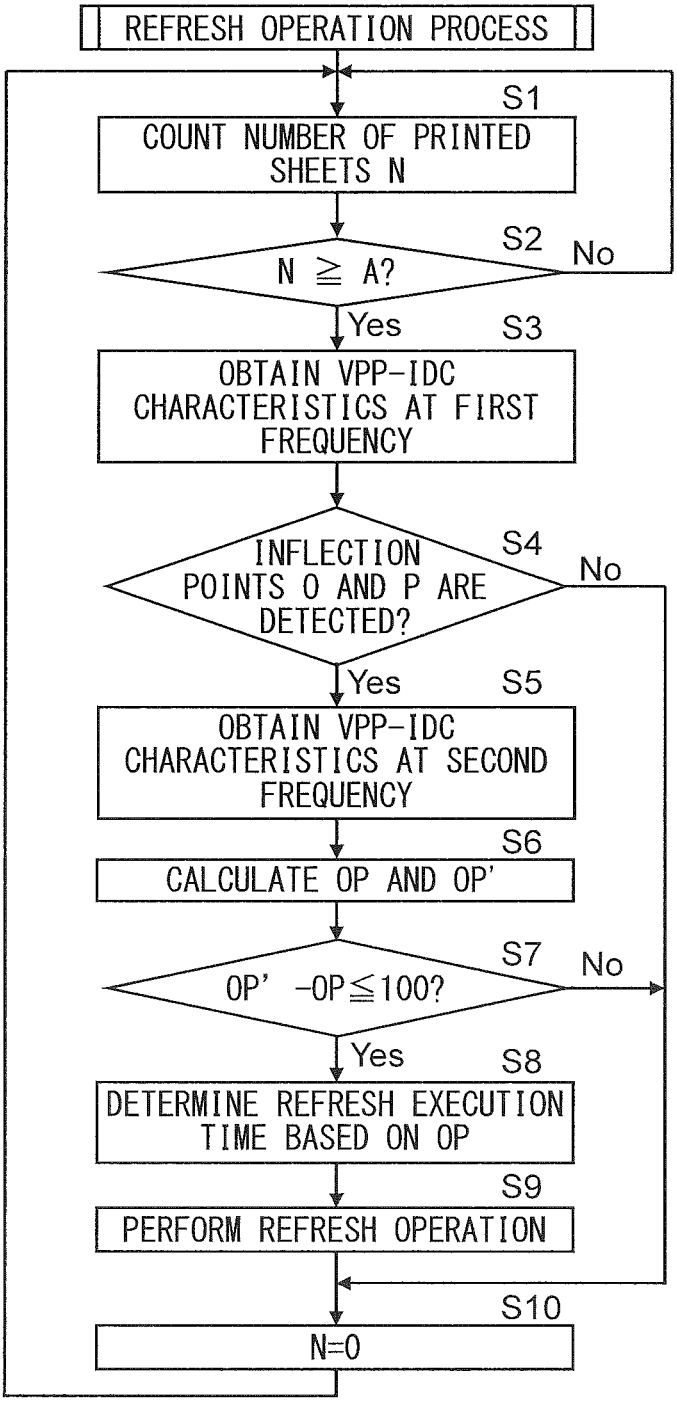
FIG. 5 is a flowchart illustrating a control example of a refresh operation performed by the image forming apparatus of the first embodiment.

FIG. 5 is a flowchart illustrating an execution control of a refresh operation in the image forming apparatus 100 of the first embodiment. An execution procedure of the refresh operation is described along the steps of FIG. 5, with reference to FIGS. 1 to 4 as necessary. Note that, the test apparatus (TASKalfa7551ci made by KYOCERA Document Solutions Inc.) was operated at a system speed of 393 mm/sec, and an a-Si photosensitive drum having a diameter of 40 mm was used as the photosensitive drum 5. The electrification method of the photosensitive drum 5 was a contact electrification method using the electrifying roller 41, and the frequency of the AC voltage applied to the electrifying roller 41 was set to 2,800 Hz as the frequency in the normal printing (first frequency) and 1,800 Hz as the frequency when obtaining the Vpp-Idc characteristics (second frequency), which is lower than the frequency in the normal printing.

First, the main controller 80 counts the number of printed sheets N (Step S1). Next, the main controller 80 determines whether or not the number of printed sheets N has reached a predetermined number A (Step S2), If N≥A holds (Yes in Step S2), the voltage controller 45 obtains the Vpp-Idc characteristics by setting the frequency of the AC voltage applied to the electrifying roller 41 to the frequency in the normal printing (first frequency) (Step S3).

Specifically, the voltage controller 45 reads an appropriate peak-to-peak voltage value from the peak-to-peak voltage table 71 stored in the storage portion 70, on the basis of temperature and humidity in the image forming apparatus 100 detected by the temperature sensor 60 and the humidity sensor 61. Then, the voltage controller 45 controls the high voltage generating circuit 43 so as to apply the AC voltage to the electrifying roller 41, so as to calculate the assumed characteristic curve L.

Next, the voltage controller 45 determines whether or not the inflection points O and P are detected from the obtained Vpp-Idc characteristics (Step S4). If the inflection points O and P are detected (Yes in Step S4), the voltage controller 45 obtains the Vpp-Idc characteristics by setting the frequency of the AC voltage applied to the electrifying roller 41 to the frequency (second frequency) lower than the frequency in the normal printing (Step S5).

Next, the voltage controller 45 calculates the inter-inflection-point voltage OP between the inflection points O and P and the inter-inflection-point voltage OP' between the inflection points O' and P' (Step S6). Then, it is determined whether or not a difference (OP'−OP) between the inter-inflection-point voltage OP' and the inter-inflection-point voltage OP is a predetermined value (in this example 100 V) or lower (Step S7). If OP'−OP≤100 holds (Yes in Step S7), it is determined that the detection of the inflection points O and P is due to the high temperature and high humidity environment, and the execution time of the refresh operation is determined based on the inter-inflection-point voltage OP (Step S8). Then, the cleaning controller 44 controls the cleaning device 19 to perform the refresh operation (Step S9). After that, the number of printed sheets N is reset (Step S10), and the process returns to Step S1 so as to repeat the same procedure (Steps S1 to S10).

On the other hand, if OP'−OP>100 holds in Step S7 (No in Step S7), it is determined that the detection of the inflection points O and P is due to deterioration of the electrifying roller 41 in the low temperature and low humidity environment, and the process proceeds to Step S10 without performing the refresh operation. Then, the process returns to Step S1 so as to repeat the same procedure (Steps S1 to S10). In addition, also if only the inflection point O is detected in Step S4, the process proceeds to Step S10 without performing the refresh operation, and the process returns to Step S1 so as to repeat the same procedure (Steps S1 to S10).

With the procedure described above, applying the electrifying roller 41 with the AC voltage having the first frequency to be applied in the normal printing so as to obtain the Vpp-Idc characteristics, when determining whether the refresh operation is necessary based on the voltage difference between the two inflection points O and P, it is possible to securely determine whether existence of the two inflection points O and P is due to the high temperature and high humidity environment or due to the deterioration of the electrifying roller 41 in the low temperature and low humidity environment. Thus, the refresh operation of the photosensitive drum 5 can be controlled to be necessity minimum. Therefore, the potential lateral flow at an edge part of the electrostatic latent image and the image deletion in the formed image caused thereby can be effectively suppressed, and longer life of the photosensitive drum 5 and reduction of power consumption can also be achieved.

Note that, instead of the procedure described above, when the inflection points O and P are detected from the Vpp-Idc characteristics obtained by setting the frequency of the AC voltage applied to the electrifying roller 41 to the frequency in the normal printing (first frequency), it is possible to obtain the Vpp-Idc characteristics by setting the frequency (second frequency) higher than the frequency in the normal printing.

In this case, the inter-inflection-point voltage OP' between the inflection points O' and P' detected from the Vpp-Idc characteristics obtained by applying the AC voltage having the second frequency becomes lower than the inter-inflection-point voltage OP between the inflection points O and P detected from the Vpp-Idc characteristics obtained by applying the AC voltage having the first frequency. Then, if the occurrence of the two inflection points O and P is due to the high humidity environment, the first inter-inflection-point voltage OP and the second inter-inflection-point voltage OP' are not largely varied even if the frequency is changed, and hence the voltage difference (OP−OP') is decreased.

On the other hand, if the occurrence of the two inflection points O and P is due to the deterioration of the electrifying roller 41 in the low temperature and low humidity environment, the second inter-inflection-point voltage OP' becomes lower than the first inter-inflection-point voltage OP, and hence the voltage difference (OP−OP') is increased. Therefore, on the basis of whether or not the difference (OP−OP') between the inter-inflection-point voltage OP' and the inter-inflection-point voltage OP is a predetermined value or less, it is possible to determine whether the detection of the inflection points O and P is due to the high temperature and high humidity environment or due to the deterioration of the electrifying roller 41 in the low temperature and low humidity environment.

In addition, in this embodiment, the frequency of the AC voltage (2,800 Hz) applied to the electrifying roller 41 in the normal printing is set as the first frequency so as to obtain the Vpp-Idc characteristics, but it is possible to set a frequency different from that in the normal printing as the first frequency so as to obtain the Vpp-Idc characteristics.

Next, the image forming apparatus 100 according to a second embodiment of the present disclosure is described. The structure of the electrifying device 4 and the control system of the image forming apparatus 100 are the same as those in the first embodiment illustrated in FIG. 2. The Vpp-Idc characteristics described above can also change depending on the linear speed of the photosensitive drum 5. Specifically, as the linear speed of the photosensitive drum 5 becomes higher, the responsiveness of the electrifying roller 41 (tracking performance of electro conductive material contained in the electro conductive layer 41*b* to the frequency) becomes lower, and Vpp at the inflection point O becomes higher to be close to the inflection point P in the characteristics as described above. However, also in the case where the electrification ability of the electrifying roller 41 is impaired, the responsiveness of the electrifying roller 41 is improved by decreasing the linear speed of the photosensitive drum 5, and hence a change appears in the Vpp-Idc characteristics. Note that, under high humidity environment that causes an image deletion, the responsiveness of the electrifying roller 41 is dominantly affected by the humidity and has no dependence on the linear speed.

Figure 6:
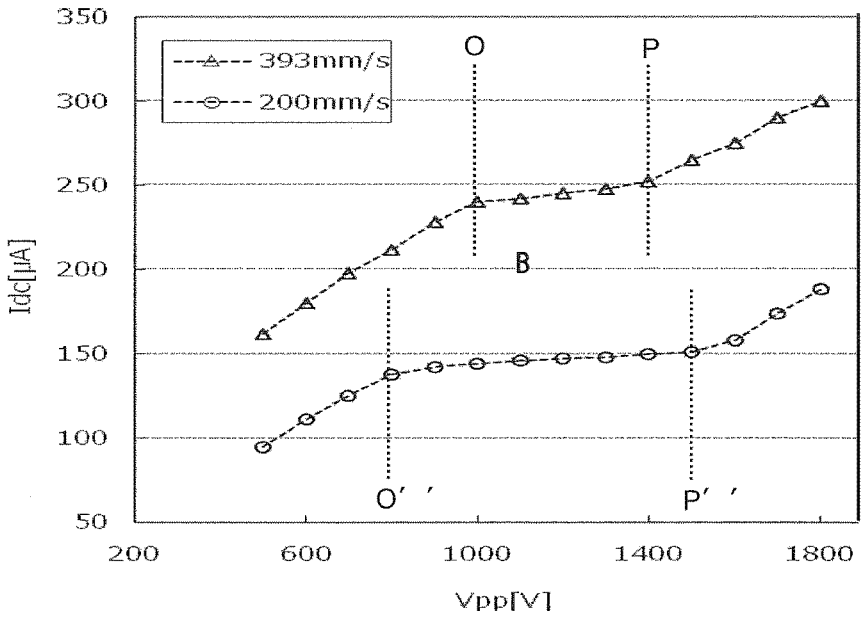
FIG. 6 is a graph illustrating an assumed characteristic curve of a relationship between the peak-to-peak voltage value Vpp and the DC current value Idc of the electrifying roller 41 when linear speed of the photosensitive drum 5 is changed in two levels.

FIG. 6 is a graph illustrating an assumed characteristic curve of a relationship between the peak-to-peak voltage value Vpp and the DC current value Idc of the electrifying roller 41 when the linear speed of the photosensitive drum 5 is changed in two levels. As illustrated in FIG. 6, the linear speed of the photosensitive drum 5 is changed in two levels of the linear speed in the normal printing and the linear speed lower than that in the normal printing, so as to obtain the Vpp-Idc characteristics. Then, there are determined the inter-inflection-point voltage OP (=Vpp(P)−Vpp(O), the first inter-inflection-point voltage) when the photosensitive drum 5 is rotated at the linear speed in the normal printing (data series of "Δ" in. FIG. 6), and an inter-inflection-point voltage OP" (=Vpp(P)"−Vpp(O)", a third inter-inflection-point voltage) when the photosensitive drum 5 is rotated at a linear speed lower than that in the normal printing (data series of "○" in FIG. 6).

If the occurrence of the two inflection points O and P is due to the high humidity environment, the first inter-inflection-point voltage OP and the third inter-inflection-point voltage OP" are not largely varied even if the linear speed of the photosensitive drum 5 is changed, and hence the voltage difference (OP"−OP) is decreased. On the other hand, if the occurrence of the two inflection points O and P is due to the deterioration of the electrifying roller 41, the third inter-inflection-point voltage OP" becomes higher than the first inter-inflection-point voltage OP, and hence the voltage difference (OP"−OP) is increased.

The image forming apparatus 100 according to the second embodiment of the present disclosure utilizes the variation of the Vpp-Idc characteristics due to the linear speed, and when determining whether or not the refresh operation is necessary, it obtains the Vpp-Idc characteristics by setting the linear speed of the photosensitive drum 5 in two levels of the linear speed in the normal printing (first linear speed) and the linear speed (second linear speed) lower than the first linear speed in the Vpp-Idc characteristics obtained by the voltage controller 45. Then, on the basis of the obtained Vpp-Idc characteristics, it is determined whether the voltage difference between the two inflection points O and P is due to the high temperature and high humidity environment or due to the deterioration of the electrifying roller 41 in the low temperature and low humidity environment.

Figure 7:
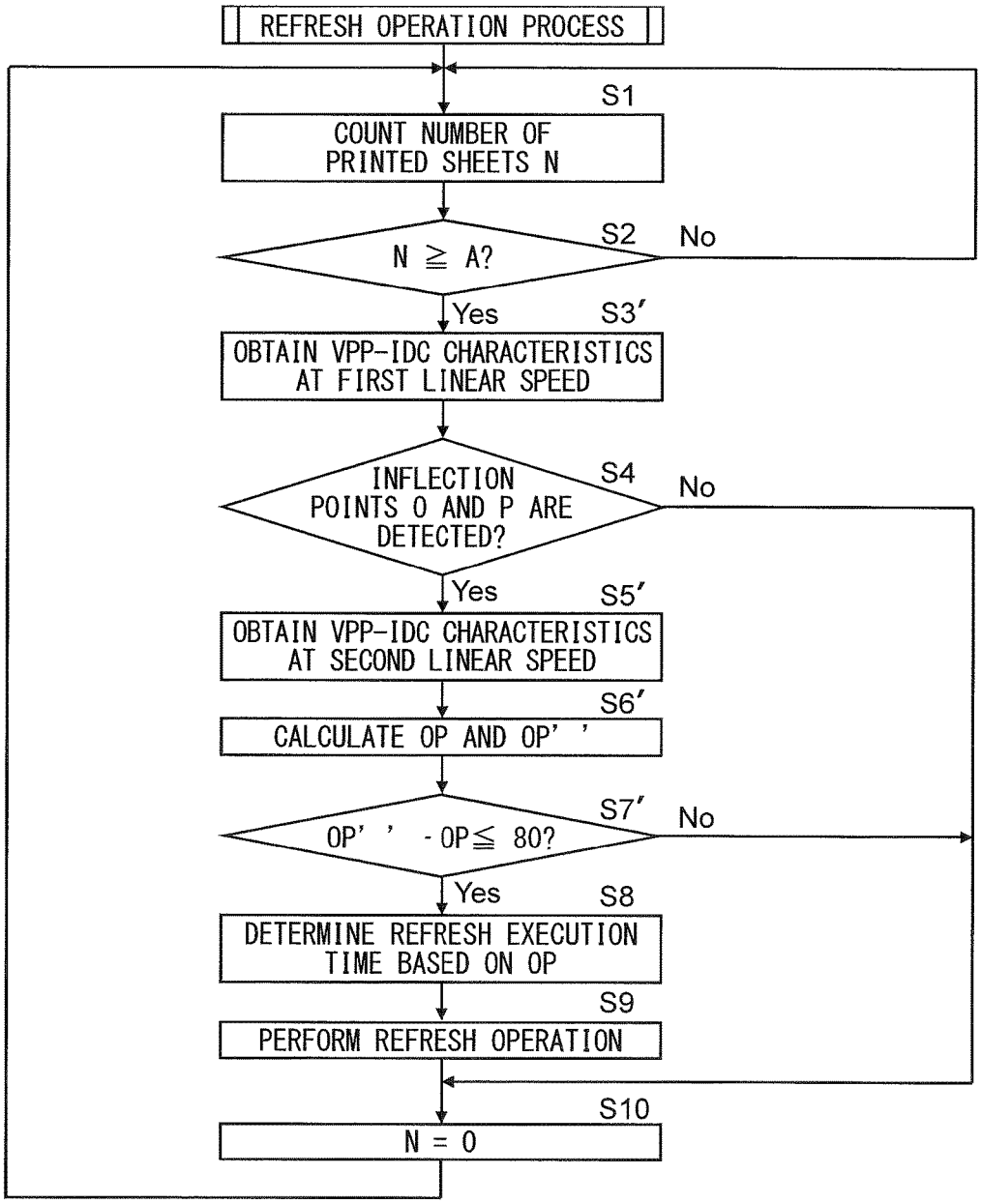
FIG. 7 is a flowchart illustrating a control example of the refresh operation performed by the image forming apparatus of a second embodiment.

FIG. 7 is a flowchart illustrating execution control of the refresh operation in the image forming apparatus 100 of the present disclosure. An execution procedure of the refresh operation is described along the steps of FIG. 7 with reference to FIGS. 1 to 3 and 6 as necessary. Note that, in the test apparatus (TASKalfa7551ci made by KYOCERA Document Solutions Inc.), an a-Si photosensitive drum having a diameter of 40 mm was used as the photosensitive drum 5. The electrification method of the photosensitive drum 5 was the contact electrification method using the electrifying roller 41, and the frequency of the AC voltage applied to the electrifying roller 41 was set to 2,800 Hz. As to the linear speed of the photosensitive drum 5, the linear speed (first linear speed) in the normal printing is set to 393 mm/sec, and the linear speed (second linear speed) when obtaining the Vpp-Idc characteristics, which is lower than the linear speed in the normal printing, is set to 200 mm/sec.

First, the main controller 80 counts the number of printed sheets N (Step S1). Next, the main controller 80 determines whether or not the number of printed sheets N has reached the predetermined number A (Step S2). If N≥A holds (Yes in Step S2), the main controller 80 rotates the photosensitive drum 5 at the linear speed in the normal printing (first linear speed) so as to obtain the Vpp-Idc characteristics (Step S3').

Specifically, on the basis of temperature and humidity in the image forming apparatus 100 detected by the temperature sensor 60 and the humidity sensor 61, the voltage controller 45 reads an appropriate peak-to-peak voltage value from the peak-to-peak voltage table 71 stored in the storage portion 70. Then, the voltage controller 45 controls the high voltage generating circuit 43 to apply the AC voltage to the electrifying roller 41 so as to calculate the assumed characteristic curve L.

Next, the voltage controller 45 determines whether or not the inflection points O and P are detected from the obtained Vpp-Idc characteristics (Step S4). If the inflection points O and P are detected (Yes in Step S4), the main controller 80 transmits the control signal to the drum driving portion 42 and drives the photosensitive drum 5 to rotate at the linear speed (second linear speed) lower than the linear speed in the normal printing, so as to obtain the Vpp-Idc characteristics (Step S5').

Next, the voltage controller 45 calculates the inter-inflection-point voltage OP between the inflection points O and P, and the inter-inflection-point voltage OP" between the inflection points O" and P" (Step S6). Then, it is determined whether or not the difference (OP"−OP) between the inter-inflection-point voltage OF' and the inter-inflection-point voltage OP is a predetermined value (in this example 80 V) (Step S7'). If OP"−OP≤80 holds (Yes in Step S7'), it is determined that the detection of the inflection points O and P is due to the high temperature and high humidity environment, and the execution time of the refresh operation is determined based on the inter-inflection-point voltage OP (Step S8). Then, the cleaning controller 44 drives the cleaning device 19 to perform the refresh operation (Step S9). After that, the number of printed sheets N is reset (Step S10), and the process returns to Step S1 so as to repeat the same procedure (Steps S1 to S10).

On the other hand, if OP"−OP>80 holds in Step S7' (No in Step S7'), it is determined that the detection of the inflection points O and P is due to the deterioration of the electrifying roller 41 in the low temperature and low humidity environment, and the process proceeds to Step S10 without performing the refresh operation. Then, the process returns to Step S1 so as to repeat the same procedure (Steps S1 to S10). In addition, also in the case where only the inflection point O is detected in Step S4, the process proceeds to Step S10 without performing the refresh operation, and the process returns to Step S1 so as to repeat the same procedure (Steps S1 to S10).

With the procedure described above, applying the AC voltage to the electrifying roller 41 as to obtain the Vpp-Idc characteristics, when determining whether the refresh operation is necessary based on the voltage difference between the two inflection points O and P, it is possible to securely determine whether existence of the two inflection points O and P is due to the high temperature and high humidity environment or due to the deterioration of the electrifying roller 41 in the low temperature and low humidity environment. Thus, the refresh operation of the photosensitive drum 5 can be controlled to be necessity minimum. Therefore, the potential lateral flow at an edge part of the electrostatic latent image and the image deletion in the formed image caused thereby can be effectively suppressed, and longer life of the photosensitive drum 5 and reduction of power consumption can also be achieved.

Note that, instead of the procedure described above, when the inflection points O and P are detected from the Vpp-Idc characteristics obtained by setting the linear speed of the photosensitive drum 5 to the linear speed in the normal printing (first linear speed), it is also possible to obtain the Vpp-Idc characteristics by setting the linear speed (second linear speed) higher than the linear speed in the normal printing.

In this case, the inter-inflection-point voltage OP" between the inflection points O" and P" detected from the Vpp-Idc characteristics obtained by rotating the photosensitive drum 5 at the second linear speed becomes lower than the inter-inflection-point voltage OP between the inflection points O and P detected from the Vpp-Idc characteristics obtained by rotating the photosensitive drum 5 at the first linear speed. Then, if the occurrence of the two inflection points O and P is due to the high humidity environment, the first inter-inflection-point voltage OP and the third inter-inflection-point voltage OP" are not largely varied even if the frequency is changed, and hence the voltage difference (OP−OP") is decreased.

On the other hand, if the occurrence of the two inflection points O and P is due to the deterioration of the electrifying roller 41 in the low temperature and low humidity environment, the third inter-inflection-point voltage OP" becomes lower than the first inter-inflection-point voltage OP, and hence the voltage difference (OP−OP") is increased. Therefore, on the basis of whether or not the difference (OP−OP") between the inter-inflection-point voltage OP" and the inter-inflection-point voltage OP is a predetermined value or less, it is possible to determine whether the detection of the inflection points O and P is due to the high temperature and high humidity environment or due to the deterioration of the electrifying roller 41 in the low temperature and low humidity environment.

In addition, in this embodiment, the linear speed of the photosensitive drum 5 in the normal printing (393 mm/sec) is set as the first linear speed so as to obtain the Vpp-Idc characteristics, but it is possible to set a linear speed different from that in the normal printing as the first linear speed so as to obtain the Vpp-Idc characteristics.

Other than that, the present disclosure is not limited to the embodiments described above but can be variously modified within the scope of the present disclosure without deviating from the spirit thereof. For example, although the execution time of the refresh operation is determined based on the first inter-inflection-point voltage OP in the embodiments described above, it is possible to control to continue the refresh operation until the inflection points on the assumed characteristic curve L become one point, after detecting the two inflection points O and P from the assumed characteristic curve L.

In addition, in the embodiments described above, there is described an example, in which, as the recovery process for decreasing frictional resistance of the surface of the photosensitive drum 5, the refresh operation of the photosensitive drum 5 is performed by the cleaning device 19. However, instead of the refresh operation, for example, it is possible to perform a process of decreasing the electrification bias applied to the electrifying roller 41 during printing, for suppressing generation of discharge products.

In addition, as a matter of course, the present disclosure is not limited to the monochrome printer as illustrated in FIG. 1 but can be applied to various image forming apparatuses such as a color copier, a color printer, a monochrome copier, a digital multifunction peripheral, and a facsimile machine.

The present disclosure can be used for an image forming apparatus capable of performing a recovery process for decreasing frictional resistance of the surface of the image carrier. Using the present disclosure, it is possible to provide an image forming apparatus that can appropriately perform the recovery process of the image carrier so as to suppress occurrence of image deletion without shortening the life of the image carrier or wasting power consumption.

What is claimed is:

1. An image forming apparatus comprising:

an image carrier having a surface on which a photosensitive layer is formed;

an electrifying member for electrifying the image carrier;

a high voltage generating circuit for applying an oscillation voltage, in which a DC voltage and an AC voltage are superimposed, to the electrifying member;

a voltage controller for controlling peak-to-peak voltage value Vpp and frequency of the AC voltage;

a current detector for detecting DC current value Idc between the electrifying member and the image carrier; and a recovery process controller for performing a recovery process for decreasing frictional resistance of the surface of the image carrier, wherein the voltage controller determines whether or not two inflection points O and P exist, which exist on a characteristic curve on a two-dimensional coordinate system indicating a relationship between the voltage value Vpp and the current value Idc, when applying the oscillation voltage to the electrifying member by setting the frequency of the AC voltage as a first frequency or by rotating the image carrier at a first linear speed so as to increase the voltage value Vpp, when the oscillation voltage is applied to the electrifying member by setting the frequency of the AC voltage as the first frequency and if the two inflection points O and P exist, a first inter-inflection-point voltage OP between the inflection points O and P and a second inter-inflection-point voltage OP' between two inflection points O' and P' are calculated, the two inflection points O' and P' existing on the characteristic curve when the oscillation voltage is applied to the electrifying member by setting the frequency of the AC voltage as a second frequency different from the first frequency so as to increase the voltage value Vpp, when the oscillation voltage is applied to the electrifying member by rotating the image carrier at the first linear speed and if the two inflection points O and P exist, the first inter-inflection-point voltage OP between the inflection points O and P and a third inter-inflection-point voltage OP" between two inflection points O" and P" are calculated, the two inflection points O" and P" existing on the characteristic curve when the oscillation voltage is applied to the electrifying member by rotating the image carrier at a second linear speed different from the first linear speed so as to increase the voltage value Vpp, and the recovery process controller performs the recovery process when a potential difference between the first inter-inflection-point voltage OP and the second inter-inflection-point voltage OP' or a potential difference between the first inter-inflection-point voltage OP and the third inter-inflection-point voltage OP" is a predetermined value or less.

2. The image forming apparatus according to claim 1, wherein the recovery process controller does not perform the recovery process if the two inflection points O and P do not exist on the characteristic curve.

3. The image forming apparatus according to claim 1, wherein when performing the recovery process, the recovery process controller continues execution of the recovery process until the inflection points O and P on the characteristic curve become one point.

4. The image forming apparatus according to claim 1, wherein when performing the recovery process, the recovery process controller determines execution time of the recovery process based on the first inter-inflection-point voltage OP.

5. The image forming apparatus according to claim 1, further comprising a rubbing member for rubbing the surface of the image carrier, wherein the recovery process is a refresh operation of grinding the surface of the image carrier by supplying toner containing abrasive to the rubbing member.

6. The image forming apparatus according to claim 1, wherein the image carrier has an amorphous silicon layer formed as the photosensitive layer.

* * * * *